US006431270B1

(12) United States Patent
Angle

(10) Patent No.: US 6,431,270 B1
(45) Date of Patent: Aug. 13, 2002

(54) DOWNHOLE TOOLS WITH A MOBILITY DEVICE

(75) Inventor: Colin M. Angle, Watertown, MA (US)

(73) Assignee: Intelligent Inspection Corporation, Alexandria, VA (US)

( * ) Notice: Subject to any disclaimer, the term of this patent is extended or adjusted under 35 U.S.C. 154(b) by 0 days.

(21) Appl. No.: 09/624,567

(22) Filed: Jul. 24, 2000

Related U.S. Application Data

(62) Division of application No. 08/891,531, filed on Jul. 11, 1997, now Pat. No. 6,112,809.
(60) Provisional application No. 60/032,183, filed on Dec. 2, 1996.

(51) Int. Cl.[7] ..... E21B 4/18; E21B 23/00
(52) U.S. Cl. ..... 166/66.5; 166/50; 166/55.7; 175/98
(58) Field of Search ..... 166/65.1, 50, 55.7, 166/66.5; 175/98

(56) References Cited

U.S. PATENT DOCUMENTS 3,827,512 A * 8/1974 Edmond ..... 175/94
4,192,380 A * 3/1980 Smith ..... 166/65.1
4,243,099 A * 1/1981 Rodgers, Jr. ..... 166/65.1
4,463,814 A * 8/1984 Horstmeyer et al. ..... 175/45
4,819,721 A * 4/1989 Long, Jr. ..... 166/55
4,986,314 A * 1/1991 Himmler ..... 138/97
5,184,676 A * 2/1993 Graham et al. ..... 166/66.4
5,794,703 A * 8/1998 Newman et al. ..... 166/381
6,003,606 A * 12/1999 Moore et al. ..... 166/381

* cited by examiner

*Primary Examiner*—Hoang Dang
(74) *Attorney, Agent, or Firm*—George A. Herbster

(57) ABSTRACT

The present invention provides a system for performing a desired operation in a wellbore. The system contains a downhole tool which includes a mobility platform that is electrically operated to move the downhole tool in the wellbore and an end work device to perform the desired work. The downhole tool also includes an imaging device to provide pictures of the downhole environment. The data from the downhole tool is communicated to a surface computer, which controls the operation of the tool and displays pictures of the tool environment. Novel tactile sensors for use as imaging devices are also provided. In an alternative embodiment the downhole tool is composed of a base unit and a detachable work unit. The work unit includes the mobility platform, imaging device and the end work device. The tool is conveyed into the wellbore by a conveying member. The work unit detaches itself from the base unit, travels to the desired location in the wellbore and performs a predefined operation according to programmed instruction stored in the work unit. The work unit returns to the base unit, where it transfers data relating to the operation and can be recharged for further operation.

6 Claims, 12 Drawing Sheets

DOWNHOLE TOOLS WITH A MOBILITY DEVICE

CROSS REFERENCE TO PROVISIONAL APPLICATION

This application is a division of U.S. application Ser. No. 08/891,531, filed Jul. 11, 1997, now U.S. Pat. No. 6,112,809, which claims the benefit of U.S. Provisional Application No. 60/032,183 filed Dec. 2, 1996 for Downhole Tools With A Mobility Device that was assigned to the assignee of this application.

BACKGROUND OF THE INVENTION

1. Field of the Invention

This invention relates generally to downhole tools for use in the oilfield and more particularly to downhole tools having a mobility device that can move the tool in the wellbore and an end work device for performing a desired operation at a selected work sites in the wellbore.

2. Background of the Art

To produce hydrocarbons (oil and gas) from the earth's formations, wellbores are formed to desired depths. Branch or lateral wellbores are frequently drilled from a main wellbore to form deviated or horizontal wellbores for recovering hydrocarbons or improving production of hydrocarbons from subsurface formations. A large proportion of the current drilling activity involves drilling highly deviated and horizontal wellbores.

The formation of a production wellbore involves a number of different operations. Such operations include completing the wellbore by cementing a pipe or casing in the wellbore, forming windows in the main wellbore casing to drill and complete lateral or branch wellbores, other cutting and milling operations, re-entering branch wellbores to perform desired operations, perforating, setting devices in the wellbore such as plugs and sliding sleeves, remedial operations such as stimulating and cleaning, testing and inspection, including determining the quality and integrity of junctures, testing production from perforated zones, collecting and analyzing fluid samples, and analyzing cores.

Oilfield wellbores usually continue to produce hydrocarbons for many years. Various types of operations are performed during the life of producing wellbores. Such operations include removing, installing and replacing different types of devices, including fluid flow control devices, sensors, packers or seals, remedial work including sealing off zones, cementing, reaming, repairing junctures, milling and cutting, diverting fluid flows, controlling production from perforated zones, activating or sliding sleeves, testing wellbore production zones or portions thereof, and making periodic measurements relating to wellbore and formation parameters.

To perform downhole operations, whether during the completion phase, production phase, or for servicing and maintaining the wellbore, a bottomhole assembly is conveyed into the wellbore. The bottomhole assembly is then positioned in the wellbore at a desired work site and the desired operation is performed. This requires a rig at the wellhead and a conveying means, which is typically a coiled tubing or a jointed pipe. Such operations usually require a rig at the wellbore and means for conveying the tubings into the wellbore.

During the wellbore completion phase, the rig is normally present at the wellhead. Occasionally, the large drilling rig is removed and a smaller work rig is erected to perform completion operations. However, many operations during the completion phase can be performed without the use of a rig if a mobility device could be utilized to move and position the bottomhole assembly into the wellbore, especially in the horizontal sections of the wellbores. During the production phase or for workover or testing operations, a rig is especially erected at the well site prior to performing many of the operations, which can be time consuming and expensive. The primary function of the rig in some of such operations is to convey the bottomhole assembly into the wellbore and to a lesser extent position and orient the bottomhole assembly at the desired work site. A mobility device that can move and position the bottomhole assembly at the desired work site can allow performing the desired downhole operations without requiring a rig and bulky tubings and tubing handling systems. Additionally, downhole tools with a mobility system, an imaging device and an end work device can perform many of the downhole operations automatically without a rig. Additionally, such downhole tools can be left in the production wellbores for extended time periods to perform many operations according to commands supplied from the surface or stored in the tool. Such operations may include periodically operating sliding sleeves and control valves, and performing testing and data gathering operations.

U.S. Pat. No. 5,186,264 to du Chaffaut, U.S. Pat. No. 5,316,094 to Pringle (Pringle '094), U.S. Pat. No. 5,373,898 to Pringle (Pringle '898) and U.S. Pat. No. 5,394,951 to Pringle et al. disclose certain structures for guiding downhole tools in the wellbores. The du Chaffaut patent discloses a device for guiding a drilling tool into a wellbore. Radially displaceable pistons, in an extension position, come into anchoring engagement with the wall of the wellbore and immobilize an external sleeve. A jack displaces the body and the drilling tool integral therewith with respect to the external sleeve and exerts a pushing force onto the tool. Hydraulic circuits and control assemblies are provided for controlling the execution of a series of successive cycles of anchoring the external sleeve in the well and of displacement of the drilling tool with respect to the external sleeve.

The Pringle '094 patent discloses an orientation mandrel that is rotatable in an orientation body for providing rotational orientation. A thruster connects to the orientation mandrel for engaging the wellbore by a plurality of elongate gripping bars. An annular thruster piston is hydraulically and longitudinally movable in the thruster body for extending the thruster mandrel outwardly from the thruster body, independently of an orientating tool.

The Pringle '898 patent discloses a tool with an elongate circular body and a fluid bore therethrough. A fixed plate extends radially between the bore and the body. A rotatable piston extends between the enclosed bore and the body and is rotatable about the enclosed bore. A hydraulic control line extends longitudinally to a piston between the plate and the piston for rotating the piston. The tool may act as orientation tool and include a rotatable mandrel actuated by the piston. A spring recocks the piston and a valve means for admitting and venting fluid from the piston.

The Pringle et al. patent discloses a bottomhole drilling assembly connectable to a coiled tubing that is controlled from the surface. A downhole motor rotates a drill bit, an articulate sub that causes the drill bit to drill a curved bore hole. A steering tool indicates the attitude of the bore hole. A thruster provides force to advance the drill bit. An orientating tool rotates the thruster relative to a coiled tubing to control the path of the borehole.

Another series of patents disclose apparatus for moving through the interior of a pipe. These include U.S. Pat. No.

4,862,808 to Hedgcoxe et al., U.S. Pat. No. 5,203,646 to Landsberger et al. and U.S. Pat. No. 5,392,715 to Pelrine. The Hedgcoxe et al. patent discloses a robotic pipe crawling device with two three-wheel modules pivotally connected at their centers. Each module has one idler wheel and two driven wheels, an idler yoke and a driveline yoke chassis with parallel laterally spaced rectangular side plates. The idler side plates are pinned at one end of the chassis and the idler wheel is mounted on the other end. The driveline side plates are pinned to the chassis and the drive wheels are rotatably mounted one at each end. A motor at each end of the chassis pivots the wheel modules independently into and out of a wheel engaging position on the interior of the pipe and a drive motor carried by the driveline yoke drives two drive wheels in opposite directions to propel the device. A motor mounted within each idler yoke allows them to pivot independently of the driveline yokes. A swivel joint in the chassis midsection allows each end to rotate relative to the other. The chassis may be extended with additional driveline yokes. In addition to a straight traverse, the device is capable of executing a "roll sequence" to change its orientation about its longitudinal axis, and "L", "T" and "Y" cornering sequences. Connected with a computer the device can "learn" a series of axis control sequences after being driven through the maneuvers manually.

The Landsberger et al. patent discloses an underwater robot that is employed to clean and/or inspect the inner surfaces of high flow rate inlet pipes. The robot crawls along a cable positioned within the pipe to be inspected or cleaned. A plurality of guidance fins rely upon the flow of water through the pipe to position the robot as desired. Retractable legs can fix the robot at a location within the pipe for cleaning purposes. A water driven turbine can generate electricity for various motors, servos and other actuators contained on board the robot. The robot also can include wheel or pulley arrangements that further assist the robot in negotiating sharp corners or other obstructions.

The Pelrine patent discloses an in-pipe running robot with a vehicle body movable inside the pipe along a pipe axis. A pair of running devices are disposed in front and rear positions of the vehicle body. Each running device has a pair of wheels secured to opposite ends of an axle. The wheels are steerable as a unit about a vertical axis of the vehicle body and have a center of steering thereof extending linearly in the fore and aft direction of the vehicle body. When the robot is caused to run in a circumferential direction inside the pipe, the vehicle body is set to a posture having the fore and aft direction inclined with respect to the pipe axis. The running devices are then set to a posture for running in the circumferential direction. Thus, the running devices are driven to cause the vehicle body to run stably in the circumferential direction of the pipe.

Additionally, U.S. Pat. No. 5,291,112 to Karidis et al. and U.S. Pat. No. 5,350,033 to Kraft disclose robotic devices with certain work elements. The Karidis et al. patent discloses a positioning apparatus and movement sensor in which a positioner includes a first section having a curved corner reflector, a second section and a third section with a an analog position-sensitive photodiode. The second section includes light-emitting-diodes (LEDs) and photodetectors. Two LEDs and the photodetectors faced in a first direction toward the corner reflector. The third LED faces in a second direction different from the first direction toward the position-sensitive photodiode. The second section can be mounted on an arm of the positioner and used in conjunction with the first and third sections to determine movement or position of that arm.

The above-noted patents and known prior art downhole tools (a) lack downhole maneuverability, in that the various elements of the tools do not have sufficient degrees of freedom of movement, (b) lack local or downhole intelligence to predictably move and position the downhole tool in the wellbore, (c) do not obtain sufficient data respecting the work site or of the operation being performed, (d) are not suitable to be left in the wellbores to periodically perform testing, inspection and data gathering operations, (e) do not include reliable tactile imaging devices to image the work site during and after performing an end work, and to provide confirmation of the quality and integrity of the work performed. Prior art tools require multiple trips downhole to perform many of the above-noted operations, which can be very expensive, due to the required rig time or production down time.

The present invention addresses some of the above-noted needs and problems with the prior art downhole tools and provides downhole tools that (a) utilize a mobility device or transport module that moves in the wellbore with predictable positioning and (b) may include any one or more of a plurality of function modules such as a module or device for imaging the desired work site and or an end work device or module that can perform a desired operation at the work site. The present invention further provides a novel mobility device or transport module, a tactile imaging function module and a cutting device as a function module for performing precision cutting operations downhole, such as forming windows in casings to initiate the drilling of branch wellbores. It is highly desirable to cut such windows relatively precisely to preserve the eventual juncture integrity and to weld the main wellbore and branch wellbore casings at the juncture.

SUMMARY OF THE INVENTION

The present invention provides a system for performing a desired operation in a wellbore. The system contains a downhole tool which includes a mobility platform that is electrically operated to move the downhole tool in the wellbore and an end work device to perform the desired operation. The downhole tool also includes an imaging device to provide pictures of the downhole environment. The data from the downhole tool is communicated to a surface computer, which controls the operation of the tool and displays pictures of the tool environment.

Novel tactile imaging devices are also provided for use with the downhole tool. One such tactile imaging device includes a rotating member that has an outwardly biased probe. The probe makes contact with the wellbore as it rotates in the wellbore. Data relating to the distance of the probe end from the tool is obtained, which is processed to obtain three dimensional pictures of the wellbore inside. A second type of tactile imaging device can be coupled to the front of the downhole tool to obtain images of objects or the wellbore ahead or downhole of the tool. This imaging device includes a probe connected to a rotating base. The probe has a pivot arm that is coupled to the base with at least one degree of freedom and a probe arm connected to the pivot arm with at least one degree of freedom. Data relating to the position of the end of the probe arm is processed to obtain pictures or images of the wellbore environment.

The present invention also provides a downhole cutting tool for cutting materials at a work site in a wellbore. The cutting tool includes a base that is rotatable about a longitudinal axis of the tool. A cutting element is carried by the base that is adapted to move in radially outward. To perform a cutting operation, the mobility platform is used to provide axial movement, the base is used to provide rotary movement about the tool axis and the cutting element movement provides outward or radial movement.

In an alternative embodiment, the downhole tool is made of a base unit and a detachable work unit. The work unit includes the mobility platform, imaging device and the end work device. The tool is conveyed into the wellbore by a conveying member, such as wireline or a coiled tubing. The work unit detaches itself from the base unit, travels to the desired location in the wellbore and performs a predefined operation according to programmed instruction stored in the work unit. The work unit returns to the base unit, where it transfer data relating to the operation and can be recharged for further operation.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, and wherein.

DETAILED DESCRIPTION OF PREFERRED EMBODIMENTS

In general the present invention provides a system with a downhole tool that includes a common mobility platform or module that is adapted to move and position the downhole tool within wellbores to perform a desired operation in the wellbore. Any number of function modules may be included in the downhole tool to perform various desired operations in the wellbores, including but not limited to imaging, end work devices such as cutting devices, devices for operating other downhole devices, etc., and sensors for making measurements relating to the wellbore and/or formation parameters.

Figure 1:
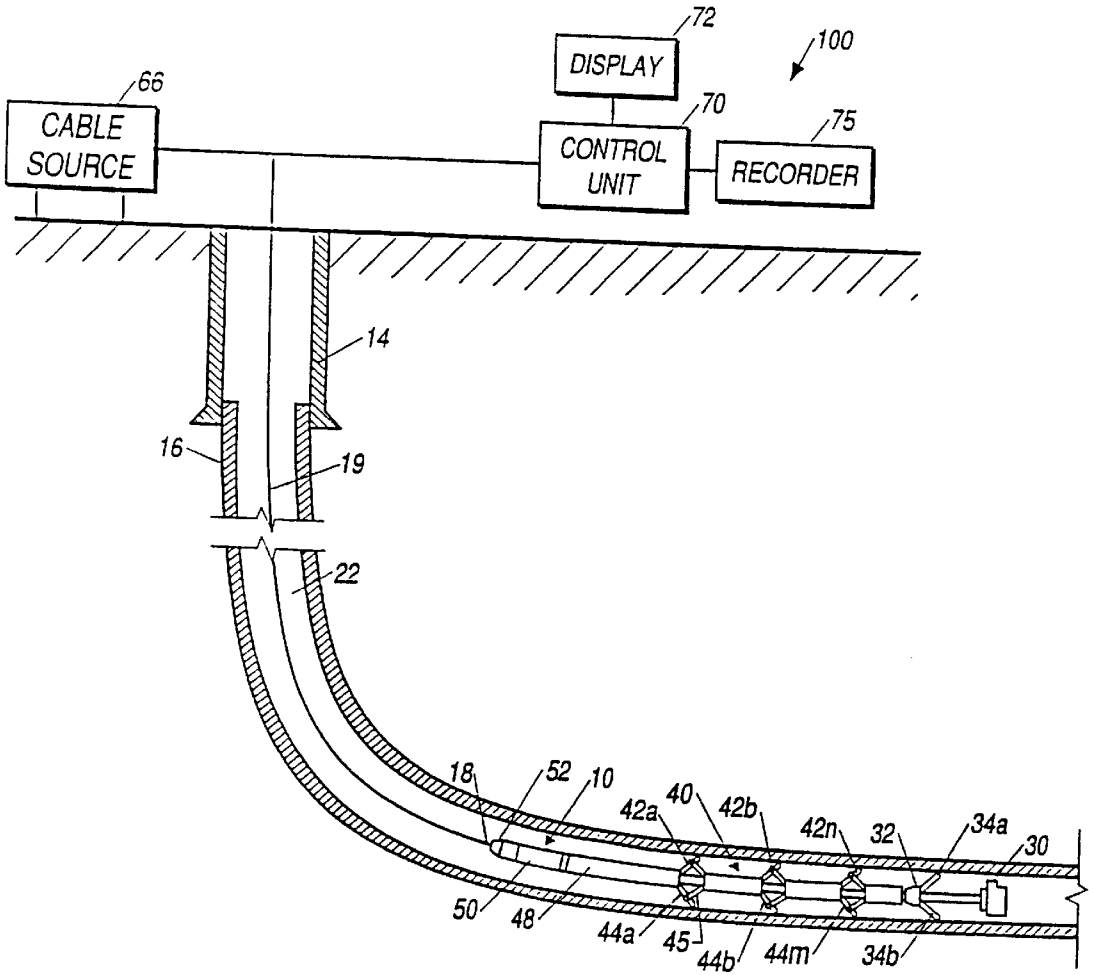
FIG. 1 is a schematic diagram of a system for performing downhole operations showing a downhole tool according to the present invention placed in a wellbore.

FIG. 1 is a schematic illustration of an embodiment of a system 100 for performing downhole operations according to the present invention. The system 100 is shown to include one embodiment of a downhole tool 10 made according to the present invention and located in a cased wellbore 15. Generally, the downhole tool 10 will be used in a cased wellbore 15 that extends from a surface location (wellhead) into the earth. The wellbore 15 may be vertical, deviated or horizontal. FIG. 1 depicts one specific embodiment of the downhole tool 10, the configuration and operation of which will be described later. However, as will become apparent, each embodiment of the tool 10 has a common architecture as shown in FIG. 2A, as described below.

Figure 2A:
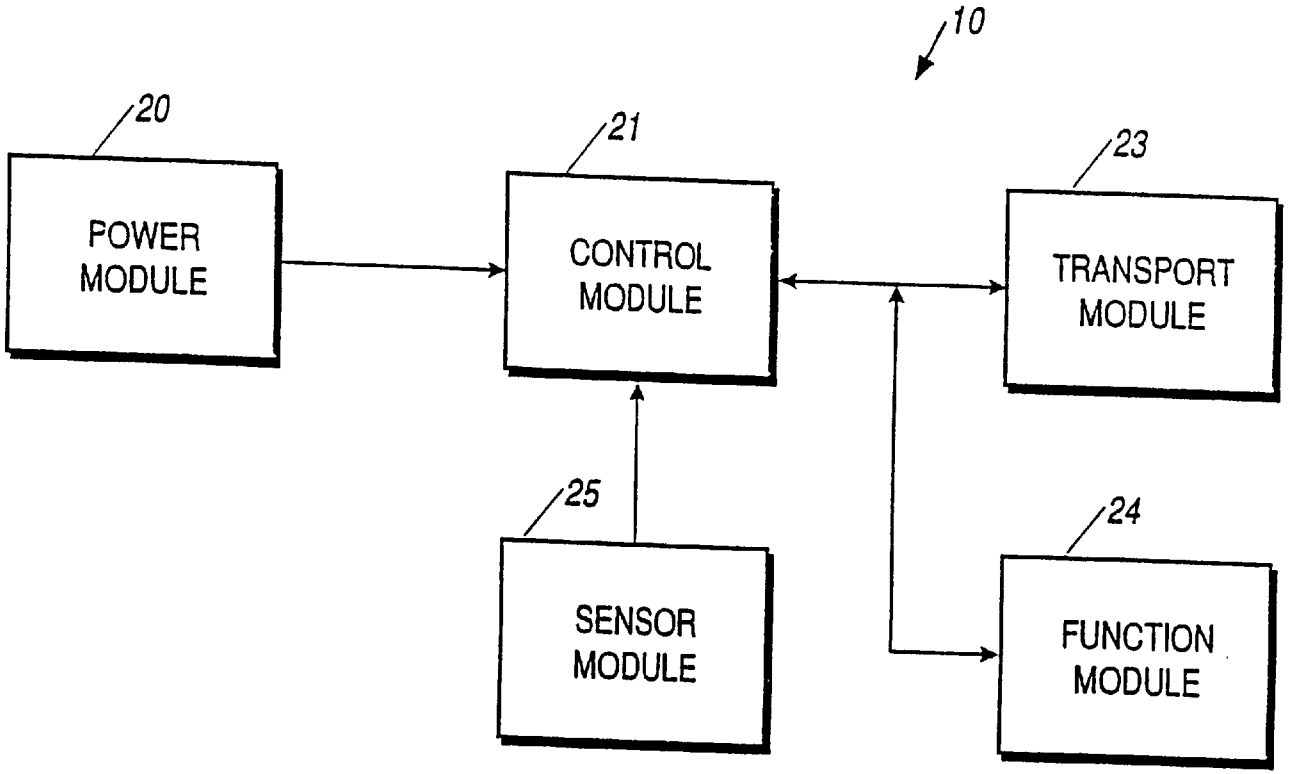
FIGS. 2A and 2B are functional block diagrams depicting the basic components of a downhole tool constructed according to the present invention.

As shown in FIG. 2A, the tool 10 includes a power module 20, a control module 21, a transport module 23, and a function module 24. The tool 10 may also include one or more sensor modules 25. The power module 20 provides power to a control module 21 and through the control module 21 to the sensor module 25, transport module 23 and the function module 24. The control module 21 utilizes signals received from the sensor module 25, transport module 23 and function module 24 to generate commands to the transport module 23 and function module 24 as appropriate. As described later, the control module 21 utilizes a conventional artificial intelligence techniques that utilize behavior control concepts by which a control problem is decomposed into a number of task achieving behaviors all running in parallel. In essence, the control module 21 enables the downhole tool 10 to respond to high-level commands by utilizing its internal control to make task-specific decisions.

The sensor module 25 can provide any number of inputs to the control module 21. As described more fully later, these inputs can be constituted by signals representing various environmental parameters or internal operating parameters or by signals generated by an imaging device or module including a video or tactile sensor. The specific selection of the sensor 25 will depend upon the nature of the task to be performed and the specific implementation of the transport module 23 and function module 24.

The transport module 23 produces predictable positioning of the downhole tool 10. The phrase "predictable positioning" is meant to encompass at least two types of positioning. The first type is positioning in terms of locating the downhole tool 10 as it moves through a wellbore. For example, if the transport module 23 implements an open-loop control, "predictable positioning" means that a command to move a certain distance will cause the downhole tool 10 to move that certain distance. The second type is fixed positioning within the wellbore. For example, if the transport module 23 positions a cutting device as a function module, "predictable positioning" means that the transport module 23 will remain at a specific location while the function module 24 is performing a defined operation.

The function module 24 can comprise any number of devices including measuring devices, cutting tools, grasping tools and the like. Other function modules could include video or tactile sensors. Examples of different function modules are provided later.

In a simple embodiment, the downhole tool 10 constructed according to this invention can comprise a self-contained power module 20, a transport module 23 and a function module 24. Such a downhole tool 10 could omit the sensor module 25 and be pre-programmed to perform a specific function.

Figure 2B:
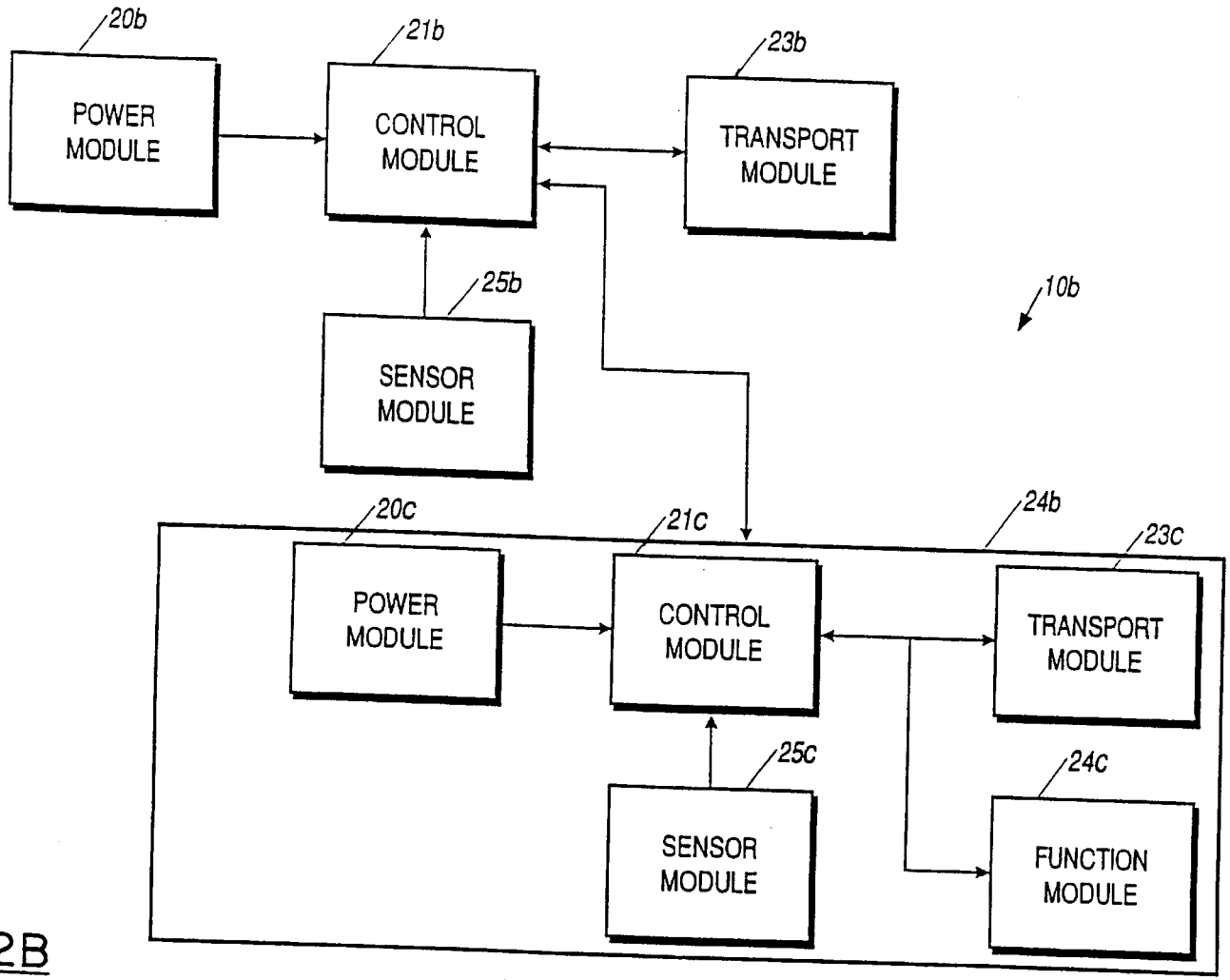

FIG. 2B depicts a more complex embodiment in which the downhole tool 10 comprises a power module 20*b* connected to the surface through a tether cable or wireline 19 with power and communications capabilities. The sensor module 25*b* could include various sensors for monitoring the operation of other modules in the downhole tool 10 in order to produce various actions in the event of monitored operational problems. The control module 21*b* could additionally receive supervisory signals in the form of high level commands from the surface via the cable 19. These modules and the transport module 23*b* could then act as a docking station for a function module 24*b* to move the function module 24*b* to a specific location in the wellbore 22. The function module 24*b* could then itself comprise another power module 20*c*, control module 21*c*, sensor module 25*c* and transport module 23*c* adapted to move from the docking station and operate independently of the docking station with a function module 24*c*.

In the specific embodiment of FIG. 1, the system 100 includes a downhole tool 10 conveyed in the cased well bore by a wireline 19 from a source 66 at the surface. The wellbore 22 is lined with a casing 14 at the upper section and with a production casing 16 at the remaining portion. In this specific embodiment the downhole tool 10 operates with a cable 19 and a control unit 70 that may contain a computer for generating the high level commands for transfer to a control module 21 associated with the downhole tool 10. The control unit 70 could also receive signals from the downhole tool 10. In such a system a recorder 75 could record and store any desired data and a monitor 72 could be utilized to display any desired information.

The downhole tool 10 in FIG. 1 includes one or more functional modules shown as an end work device 30 for performing the desired downhole operations and an imaging device 32 for obtaining images of any desired portion of the casing or an object in the wellbore 22. A common mobility platform or transport module 40 moves the downhole tool 10 in the wellbore 22. The downhole tool 10 also may include any number of other sensors and devices in one or more sensor modules generally denoted herein by numeral 48. A two-way telemetry system 52 provides two-way communication between the downhole tool 10 and the surface control unit 70 via the wireline 19.

The downhole sensors and devices 48 may include sensors for measuring temperature and pressure downhole, sensors for determining the depth of the tool in the wellbore 22, direct or indirect position (x, y, and z coordinates) of the tool 10, inclinometer for determining the inclination of the tool 10 in the wellbore 22, gyroscopic devices, accelerometers, devices for determining the pull force, center line position, gripping force, tool configuration and devices for determining the flow of fluids downhole. The tool 10 further may include one or more formation evaluation tools for determining the characteristics of the formation surrounding the tool in the wellbore 22. Such devices may include gamma ray devices and devices for determining the formation resistivity. The tool 10 may include devices for determining the wellbore 22 inner dimensions, such as calipers, casing collar locator devices for locating the casing joints and determining the correlating tool 10 depth in the wellbore 22, casing inspection devices for determining the condition of the casing, such as casing 14 for pits and fractures. The formation evaluation sensors, depth measuring devices, casing collar locator devices and the inspection devices may be used to log the wellbore 22 while tripping into and or out of the wellbore 22.

The two-way telemetry 52 includes a transmitter for receiving data from the various devices in the tool 10, including the image data, and transmits signals representative of such data to the surface control unit 70. For wireline communication, any suitable conductor may be utilized, including wire conductors, coaxial cables and fiber optic cables. For non-wireline telemetry means, electromagnetic transmitters, fluid acoustic transmitters, tubular fluid transmitters, mud pulse transmitters or any other suitable means may be utilized. The telemetry system also includes a receiver which receives signals transmitted from the surface control unit 70 to the tool 10. The receiver communicates such received signals to the various devices in the tool 10.

FIG. 1 discloses one embodiment of a function module in the form of a tactile sensor having one or more sensory probes, such as probes 34*a–b*. Two tactile imaging devices having sensory probes for use in the tool 10 of the present invention are described later in references to FIGS. 3–5. However, any other suitable imaging device, such as an optical device, microwave device, an acoustic device, ultrasonic device, infrared device, or RF device may be utilized in the tool 10 as a function module. The imaging device 32 may be employed to provide pictures of the work site or an object in the wellbore 22 or to determine the general shape of the object or the work site or to distinguish certain features of the work site prior to, during and after the desired operation has been performed at the work site.

Still referring to FIG. 1, the end work device 30 may include any device for performing a desired operation at the work site in the wellbore. The end work device 30 may include a cutting tool, milling tool, drilling tool, workover tool, testing tool, tool to install, remove or replace a device, a tool to activate a device such as a sliding sleeve, a valve, a testing device to perform testing of downhole fluids, etc. Further, the tool 10 may include one or more end work devices 30. A novel cutting and milling device for use with tool 10 is described later with reference to FIG. 3. The legs 42 and the rigidity of the tool 10 body keep the tool 10 centered in the wellbore 22.

The construction and operation of the mobility platform 40 will now be described while referring to FIGS. 1, 3 and 9–12. The mobility platform or transport module 40 preferably has a generally tubular body 102 with a number of reduced diameter sections 102*a*–102*n*. Each of the reduced diameter sections 102*a*–102*n* has a respective transport mechanism 42*a*–42*n* around its periphery. Each transport mechanism 42*a*–42*n* includes a number of outwardly or radially extending levers or arm members 44*a*–44*m*. The levers 44*a*–44*m* for each of the transport mechanisms 42*a*–42*n* extend beyond the largest inside dimension of the wellbore portion in which the tool 10 is to be utilized, in their fully extended position.

Figure 9:
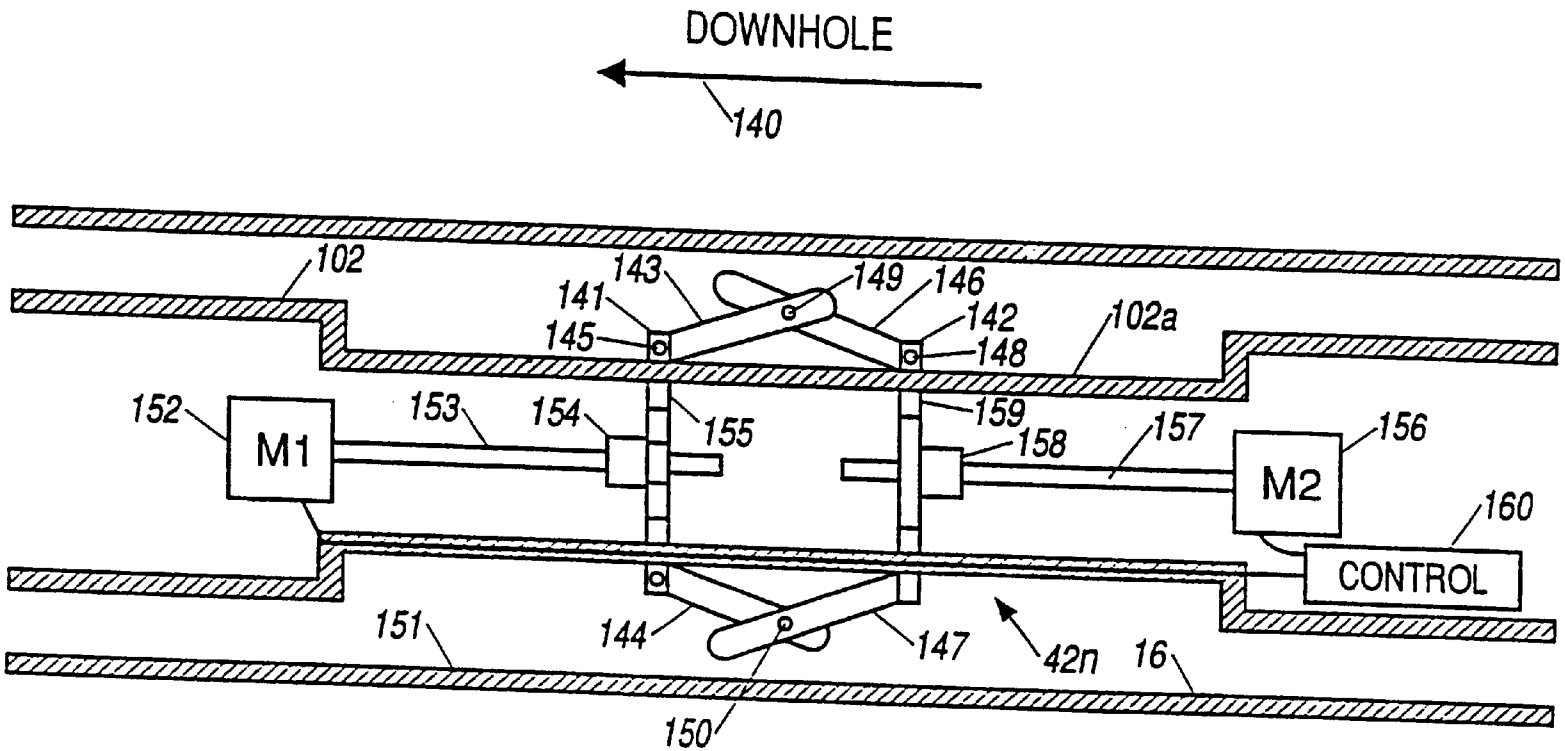
FIG. 9 is a plan view of a transport mechanism useful in the devices shown in FIGS. 1, 3, 6 and 7.

FIG. 9 depicts a portion of the mobility platform 40 of the downhole tool 10 in a horizontal portion of the wellbore casing 16 with particular emphasis on the transport mechanism 42*n* between enlarged diameter portions of the tubular body 102 at the extremities of a reduced diameter suction 102*n*. In FIG. 9 an arrow 140 points downhole. In the following discussion, the terms "proximal" and "distal" are used to define relative positions with respect to the wellhead.

That is something that is "proximal" is toward the wellhead or uphole or toward the right in FIG. 9 while something that is "distal" is "downhole" or toward the left in FIG. 9. During operation, the downhole tool 10 aligns itself with the casing 16 longitudinal axis.

Still referring to FIG. 9, it depicts two spaced exterior annular braces 141 and 142 in the distal and proximal positions, respectively, and preferably formed as a magnet structures. A pair of arms 143 and 144 extend proximally from the distal brace 141. A pin 145 represents a pivot joint for each of the arms 143 and 144 with respect to the distal brace 141. A similar structure comprising arms 146 and 147 attaches to pivot with respect to the proximal brace 142 by pins, such as a pin 148 shown with respect to arm 146. The arms 146 and 147 extend distally with respect to the proximal brace 142. Correspondingly radially positioned arms, such as arms 143 and 146, overlap and are pinned. In FIG. 9 a pin 149 connects the end portions of the arms 143 and 146; a pin 150, the arms 144 and 147. In this particular embodiment the arms 146 and 147 are longer than the corresponding arms 143 and 144.

With this construction the arms pivot radially outward when the braces 141 and 142 move toward each other. The respective arm lengths assure that the ends of the arms 146 and 147 engage the inner surface 151 of the casing 16 before the braces 141 and 142 come into contact. When the braces 141 and 142 move apart, the arms collapse or retract toward the reduced diameter section 102*n* and release from the well casing 116.

FIG. 9 depicts two sets of arms spanning the space between the braces 141 and 142. It will be apparent that more than two sets of arms can span the braces. In a preferred embodiment, three sets of arms are utilized to assure centering of the tool 10 in the casing 16. In accordance with one embodiment of this invention, a reversible motor 152 controls a drive screw 153 and ball connector 154 that attaches to an annular magnet member 155. The magnet member 155 traverses the interior portion of the tubular body reduced diameter section 102*n*. It is stabilized in that body by conventional mechanisms that are not shown for purposes of clarity. With this construction, actuating the motor 152 produces a translation (movement) of the magnet member 155 proximally or distally with the plane of the magnet member 155 remaining normal to the longitudinal axis of the tool 10. Similarly, a reversible motor 156 actuates a drive screw 157 and, through a ball connection 158, causes a translation of a magnet member 159.

If the braces 141 and 142 are constructed as magnet structures and the reduced diameter portion 102*n* has magnetic permeability, a magnetic coupling will exist between the inner magnet members 155 and 159 and the magnet braces 141 and 142. That is, translation of the magnet member 155 will produce corresponding translation of the magnet brace 141 while translation of the magnet member 159 will produce corresponding translation of the magnet brace 142. This coupling can be constructed in any number of ways. In one such approach, a system of magnetically-coupled rodless cylinders, available under the trade name "Ultran" from Bimba Manufacturing Company provide the magnetic coupling having sufficient strength.

In accordance with another aspect of this invention, a control 160 operates the motors 152 and 156 to displace the braces 141 and 142 either simultaneously or differentially with respect to each other to achieve necessary actions that can produce different results. Two specific tasks are described that establish a characteristic of predictable position. The first is the task that enables the transport mechanism 42*a* 42*n* to move the tool along the casing 16 to the left in FIG. 9 or downhole. The second task positions the tool 10 stably within the casing 16 at a working position.

Figure 10:
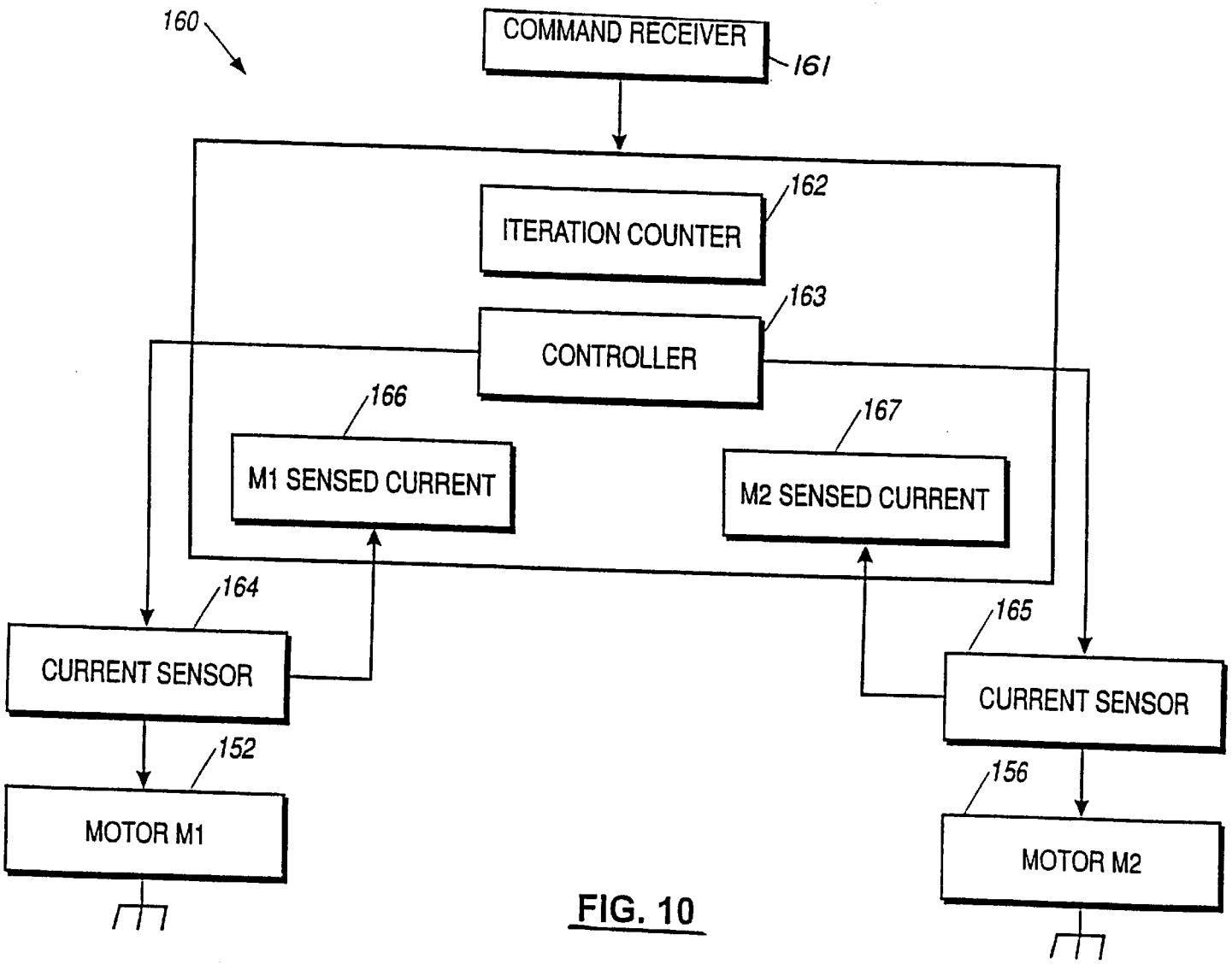
FIG. 10 is a block diagram of basic operations of the operating system useful in connection with the transport mechanism of FIG. 9.

FIG. 10 depicts the organization of the control 160 in terms of modules that can be implemented by registers in a digital computer system. The control 160 includes a command receiver 161 that can respond to a number of high level commands. One command might be: MOVE{direction}{distance}. In a simple implementation, it will generally be known that a complete cycle of operation of the positioning devices such as positioning device 42*n* in FIG. 9 will produce a known incremental translation of the tool along the pipe. The command receiver 161 in FIG. 10 can then produce a number of iterations for an iteration counter 162 that corresponds to the total distal to be traversed divided by that incremental distance. Alternatively, the command itself might contain the total number of iterations (i.e., the total number of incremental distances to be moved).

A controller 163 produces an output current for driving the motors 152 and 156 independently. As will become apparent, one method of providing feedback is to drive the motors to a stall position. Current sensors 164 and 165 provide inputs to M1 sensed current and M2 sensed current registers 166 and 167 to indicate that the current in either of the motors 152 or 156 has exceeded a stall level. There are several well-known devices for providing such an indication of motor stall and are thus described here in detail.

Figure 11:
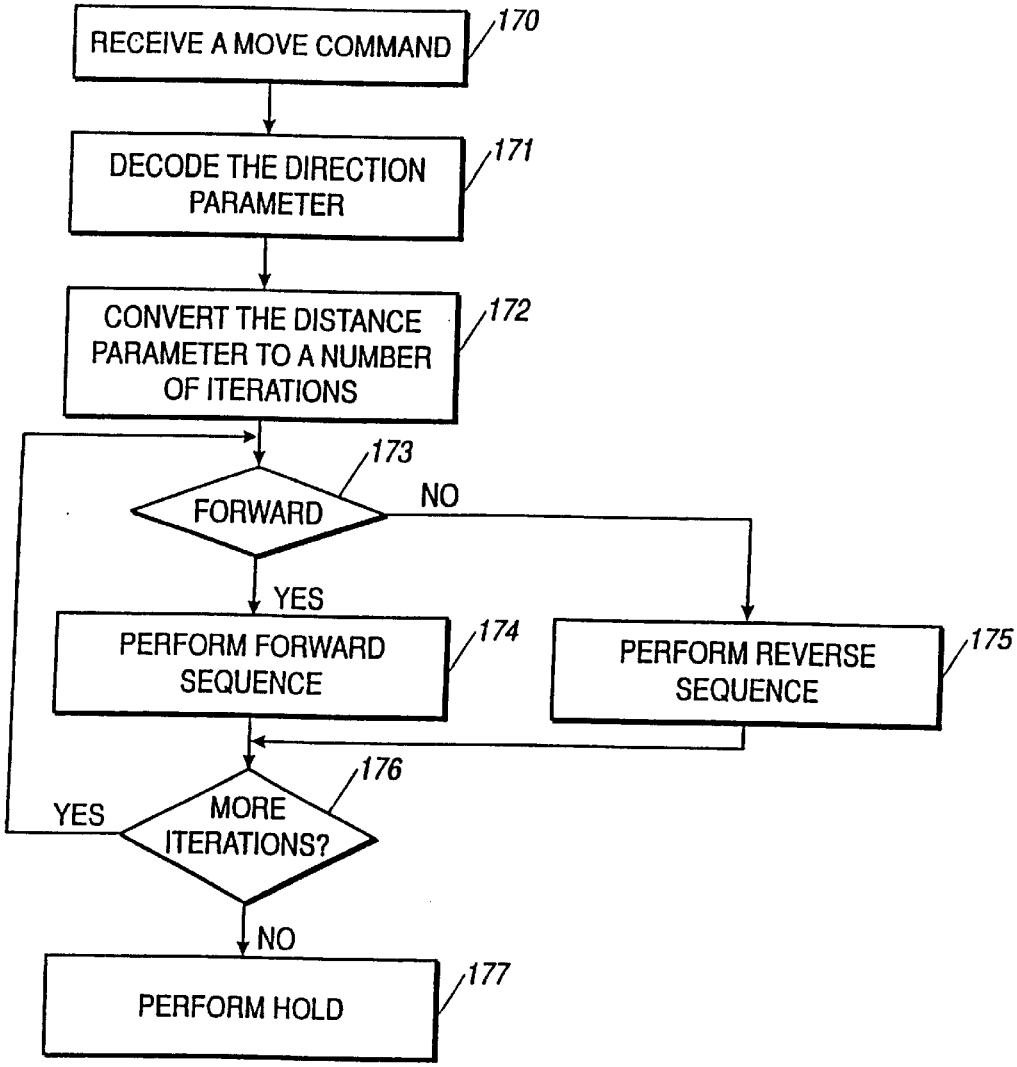
FIG. 11 is a flow diagram of the basic operations of the operating system of FIG. 10.

FIG. 11 depicts a general flow of tasks that can occur in response to the receipt of a move command in step 170 and that, in an artificial intelligence based system, occur in parallel with other tasks. Specifically, in accordance with this particular task implementation step 171 decodes the direction parameter to determine whether a forward or reverse sequence will be required to move the tool 10 distally or proximally, respectively. In step 172 the system converts the distance parameter to a number of iterations if the command specifies distance in conventional terms, rather than at a number of iterations.

Step 173 branches based upon the decoded value of the direction parameter. If the move command is directing a distal motion or downhole motion, procedure 174 is executed. Procedure 175 causes the transport module to move the tool 10 proximally, that is uphole. Step 155 alters and monitors the value of the iteration counter 162 in FIG. 10 to determine when the transport has been completed. Control branches back to produce another iteration by transferring control back to step 173 while the transport is in process. When all the iterations have been completed, control transfers to step 177 that generates a hold function to maintain the tool at its stable position within the casing 16.

Figure 12:
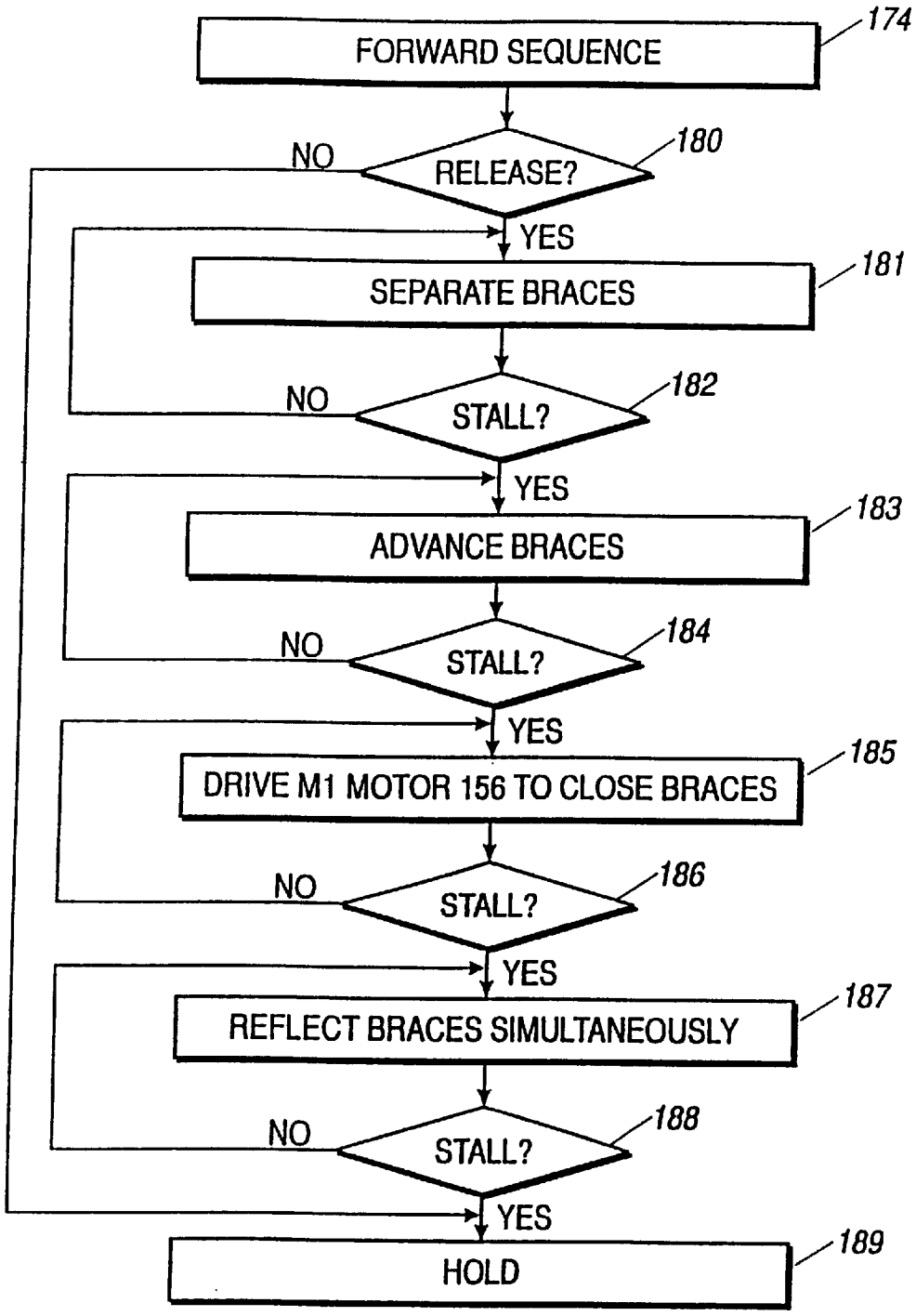
FIG. 12 is a flow diagram of "perform forward sequence" procedure used in the flow diagram of FIG. 11.

When the control operation shown in FIG. 11 requires a forward sequence procedure 174, control passes to a series of tasks shown in FIG. 12. FIG. 12 shows the operation for a single transport mechanism 42*n* shown in FIG. 9. As shown in FIG. 9, to release or retract the arms 146 and 147, the step 180 transfers control to step 181 which separates the braces 141 and 142 by translating the distal brace 141 distally and translating the proximal brace 142 proximally. At some point in this process the linkages provided by the arms 143, 144, 146 and 147 will block further separation of the braces 141 and 142. The current as monitored by the current sensors 164 and 165 will rise to a stall level. When this occurs, step 182 transfers control to step 183. Otherwise the control system stays in a loop including steps 181 and 182 to further separate the braces 141 and 142.

In a loop including steps 183 and 184, the controller 163 in FIG. 10 energizes the motors 152 and 156 to move the braces 141 and 142 simultaneously and distally, that is to the left in FIG. 9. When the brace 141 reaches a distal stop, that can be a mechanical stop or merely a limit on the drive screw 153, the current sensors 164 and 165 will again generate a signal indicating a stall condition. Then step 184 transfers control to a step 185 that is in a loop with step 186 to close the braces.

In this particular sequence, step 185 energizes the motor 156 to advance the brace 142 distally causing the arms to move radially outward. The motor 152 remains de-energized, so the brace 141 does not move, even when forces are applied to the brace 141 because there is a large mechanical advantage introduced by the drive screw 153 and ball connection 154 that blocks any motion. When the ends of the arms 146 and 147 engage the casing 16, a stall condition will again exist for the motor 156. The controller 163 in FIG. 10 responds to the stall condition, as sensed by the M2 sensed current register 167, by transferring control to step 187.

The loop including steps 187 and 188 then energizes both the motors 152 and 156 simultaneously to move the braces proximally with respect to the tool. This occurs without changing the spacing between the braces 141 and 142 so the braces maintain a fixed position with respect to the casing 16. Consequently, the tool moves distally. The loop including steps 187 and 188 continues to move the braces 141 and 142 simultaneously until the braces reach a proximal limit. Now the existence of the stall condition in the motor 156 causes step 188 to transfer control to step 189 that produces a hold operation with the arms in firm contact with the casing 16.

The foregoing description is limited to the operation of a single transport mechanism 42*n*. If the tool includes three-spaced devices that are operated to be 120° out-of-phase with respect to each other, the action of the controller 160 or corresponding controllers for the different transport mechanisms will assure a linear translation of the tool with two of the mechanisms being in contact with the pipe 16 at all times. Consequently the tool remains in the center of the well casing 16 and the advance occurs without slippage with respect to the well casing 16. This assures that the step 172 in FIG. 11 of converting the distance parameter into a number of iterations is an accurate step with predictable positioning even in an open-loop operation. As will be apparent, it is possible that a particular iteration will stop with each of the mechanisms 42*a*–42*n* at a different phase of its operation. On stopping, the sequence shown in FIG. 12 would be modified to produce the hold operation.

The previously mentioned hold operation, as shown in step 177 of FIG. 11, energizes the drive motors 152 and 156 to drive the braces 141 and 142 together. When the arms contact the inside of the casing 16, the motor current will again rise to the stall value and the task will terminate. As will be apparent, this operation could also be performed by moving only one of the motors 152 and 156. Moreover, the mechanical advantage of the drive mechanism assures that the downhole tool 10 remains firmly attached to the casing 16. That is, the transport mechanisms 42*a*–42*n* assure that the downhole tool 10 is positioned with predictability.

FIGS. 9 through 12 depict a construction and operation in which both motors 151 and 156 attach to the transport module 102 to displace their respective braces 141 and 142 independently with respect to the body of the transport module 102. It is also possible to mount one motor, such as motor 152, to the transport module 102 to drive one brace, such as brace 142, relatively to the transport module 102 and mount the other motor, such as motor 156, to the brace 141. In this configuration, the motor 156 drives the brace 142 relative to, or differently with respect to, the brace 141. The changes required to the control to implement such a configuration change are trivial and therefore not discussed.

While the foregoing description defines a movement in terms of a prespecified distance, it is also possible for the movement to be described as movement to a position at which some condition as sensed. For example, if the downhole tool 10 incorporates a tactile sensor, the command might be to move until the tactile sensor identifies an obstruction or other diameter reduction.

To ensure positive traction against the walls of the wellbore 22, the levers 44 should be able to exert a force against the walls at least twice as large as the weight of the tool 10 and force due to the flow of fluids in the wellbore 22. Assuming a neutral force amplification through the levers, the magnetic collars 106 must be able to transfer at least sixty (60) pounds of linear force, which is substantially less than the 300 pounds of force available by utilizing commercially available magnets. With a brace 42*n* having 3.5 inch long arms 146 and 147 and 2.5 inch long short arms 143 and 144, the force amplification for a seven-inch diameter wellbore 22 would be 1.5, while the same bar lengths would produce a force amplification factor in a four-inch wellbore of 0.4. Thus, for a 300 pound linear force, the radial force for the seven-inch diameter would be 450 pounds while that for the four inch bore would be 120 pounds. It should be noted that the numerical values stated above are provided as examples of mechanisms that may be utilized in the mobility platform 40 and are in no way to be construed as any limitations.

Figure 3:
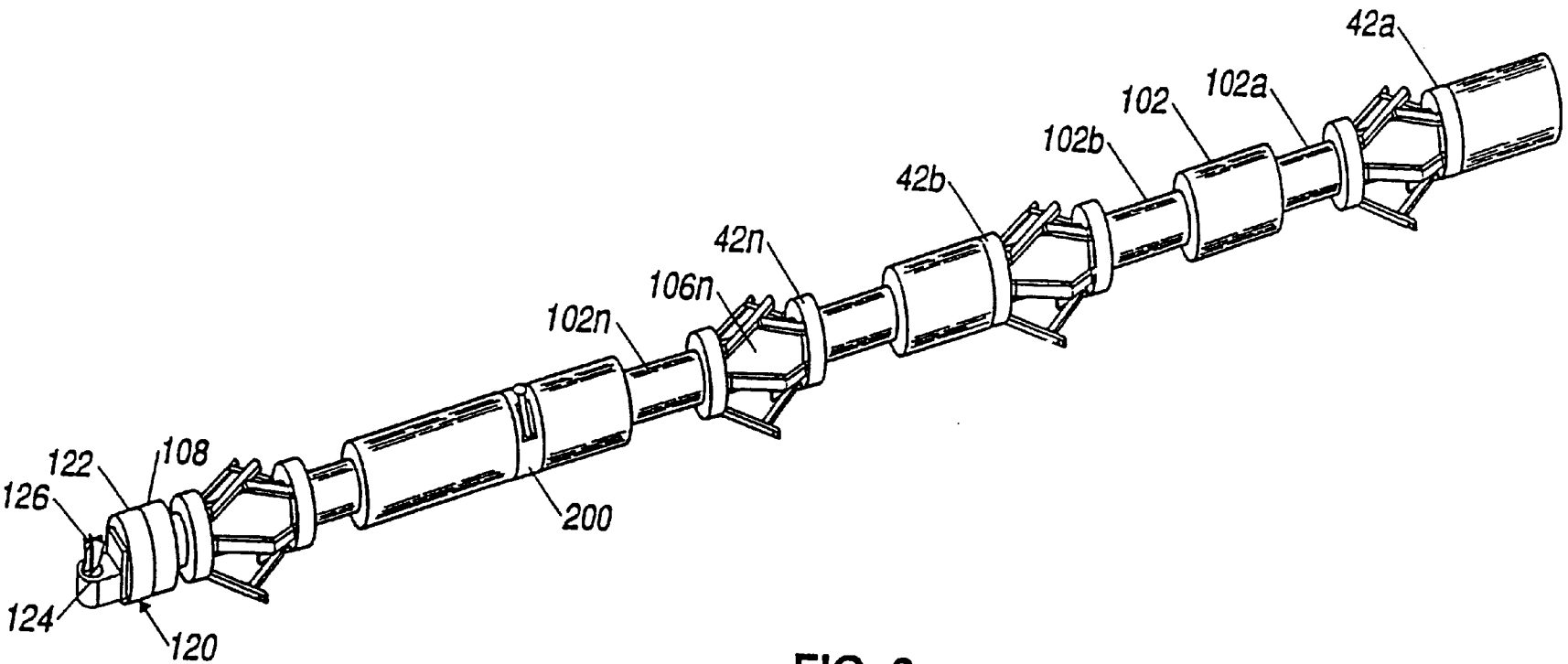
FIG. 3 is an isometric view of an embodiment of a portion of the downhole tool of the present invention that includes a mobility device, a tactile imaging device and an end work device in the form of a cutting device module.

Referring back to FIGS. 1–3, the tool 10 could include a function module 30 as a cutting device 120 at the downhole end of the tool 10. The cutting device 120 can be made as a module that can be rotatably attached to the body 102 at a joint 108. In the embodiment of FIG. 3, the cutting device 120 has a rotatable section 122 which can be controllably rotated about the longitudinal axis of the tool 10, thereby providing a circular motion to the cutting device 120. A suitable cutting element 126 is attached to the rotatable section 122 via a base 124. The base 124 can move radially, i.e., normal to the longitudinal axis of the tool 10, thereby allowing the cutting element 126 to move outwardly radially to the wellbore 22. In addition to the above-described movements or the degrees of freedom of the tool, the cutting device 120 may be designed to move axially independent of the tool body 102, such as by providing a telescopic type action. The rotary motion of the rotatable section 122 and the radial motion of the cutting element 126 are preferably controlled by electric motors (not shown) contained in the cutting device 120. The cutting device 120 can be made to accommodate any suitable cutting element 126. In operation, the cutting element 126 can be positioned at the desired work site in the wellbore 22, such as a location in the casing 14 to cut a window thereat, by a combination of moving the entire tool 10 axially in the wellbore 22, by rotating the base 124 and by outwardly moving the cutting element 126 to contact the casing 16.

To perform a cutting operations, such as cutting a window in the casing 16, the cutting element 126 is rotated at a desired speed, like a drill, and moved outward to contact the casing 16. The rotary action of the cutting element 126 cuts the casing 16. The cutting element 126 can be moved in any desired pattern to cut a desired portion of the casing 16. The cutting profile may be stored in the control circuitry contained in the tool 10, which causes the cutting element 126 to follow the desired cutting profile. To avoid cutting large pieces, which may become difficult to retrieve from the wellbore 22, the cutting element 126 can be moved in a grid pattern of any other desired pattern that will ensure small cuttings. During cutting operations, the required pressure on the cutting element 126 is exerted by moving the base 124 outward. The type of the cutting element 12C defines the dexterity of the window cut by the cutting device 120. The above-described cutting device 120 can cut precise windows in the casing 16. To perform a reaming operation, the cutting element 120 may be oriented to make cuts in the axial direction. The size of the cutting element 126 would define the diameter of the cut.

To perform cutting operations downhole, any suitable cutting device 120 may be utilized in the tool 10, including torch, laser cutting devices, fluid cutting devices and explosives. Additionally, any other suitable end work device 30 may be utilized in the tool 10, including a workover device, a device adapted to operate a downhole device such as a sliding sleeve or a fluid flow control valve, a device to install and/or remove a downhole device, a testing device such as to test the chemical and physical properties of formation fluids, temperatures and pressures downhole, etc.

The tool 10 is preferably modular in design, in that selected devices in the tool 10 are made as individual modules that can be interconnected to each other to assemble the tool 10 having a desired configuration. It is preferred to form the image device 32 and end work devices 30 as modules so that they can be placed in any order in the tool 10. Also, it is preferred that each of the end work devices 30 and the image device 32 have independent degrees of freedom so that the tool 10 and any such devices can be positioned, maneuvered and oriented in the wellbore 22 in substantially any desired manner to perform the desired downhole operations. Such configurations will enable a tool 10 made according to the present invention to be positioned adjacent to a work site in a wellbore, image the work site, communicate such images online to the surface, perform the desired work at the work site, and confirm the work performed during a single trip into the wellbore.

In the configuration shown in FIG. 3, the cutting element 126 can cut materials along the wellbore interior, which may include the casing 16 or an area around a junction between the wellbore 22 and a branch wellbore. To cut the casing 16, the cutting element 126 is positioned at a desired location. In applications where the material to be cut is below the cutting tool 120, the cutting element 126 may be designed with a configuration that is suitable for such applications.

Figure 4:
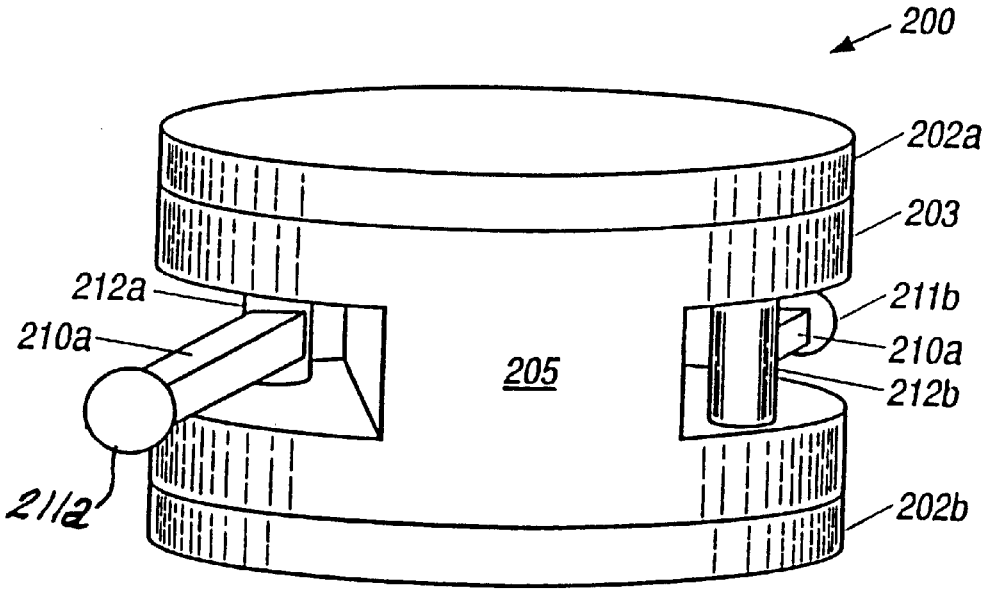
FIG. 4 is an exploded isometric view of the tactile imaging device shown in FIG. 3.
Figure 5:
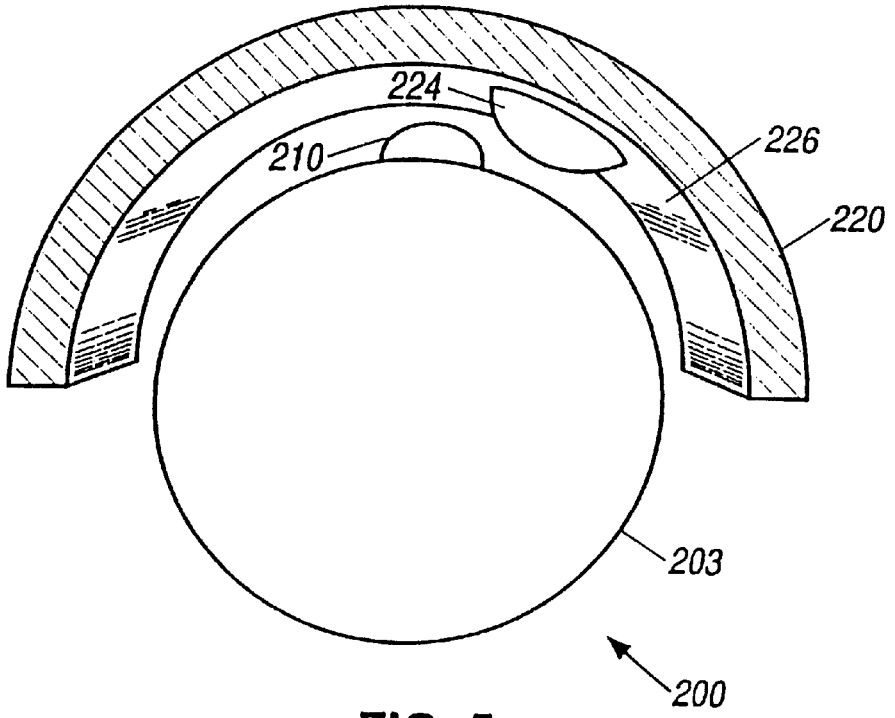
FIG. 5 is an isometric view showing the tactile imaging device of FIG. 4 disposed in a section of pipe having an obstruction at its inside.

As noted-above, the tool 10 may utilize an imaging device to provide an image of the desired work site. For the purpose of this invention any suitable imaging device may be utilized. As noted-earlier, a tactile imaging device is preferred for use with cutting devices as the end work device 30. FIG. 3 illustrates a side-look tactile imaging device 200 according to the present invention carried by the tool 10. FIG. 4 is an isometric view of the tactile imaging device 200. FIG. 5 shows the tactile imaging device 200 placed in a cut-away tubular member 220 having an internal obstruction. Referring to FIGS. 3–5, the imaging device 200 has a rotatable tubular section 203 between two fixed segments 202*a* and 202*b*.

The imaging device 200 is held in place at a suitable location in the tool 10 by the fixed segments 202*a* and 202*b*. The rotating section 203 preferably has two cavities 212*a* and 212*b* at its outer or peripheral surface 205. The cavities 212*a* and 212*b* respectively house their corresponding imaging probes 210*a* and 212*b*. In the fully retracted positions, the probes 210*a* and 210*b* lie in their respective cavities 212*a* and 212*b*. In operations, the probes 210*a* and 210*b* extend outward, as shown in FIG. 4. Each probe 210*a* and 210*b* is spring biased, which ensures that the probes 210*a*–210*b* will extend outward until they are fully extended or are stopped by an obstruction in the wellbore 22. FIG. 5 shows a view of the imaging device 200 placed inside a section of a hollow tubular member 220. The tubular member 220 has an obstruction 224.

In operation, the rotatable section 203 which carries the probes 210*a*–210*b* is continuously rotated at a known speed (rpm). The outwardly extended probes 210*a* and 210*b* follow the contour of the containing boundary. The probes 210*a*–210*b* are passive devices which utilize springs to force them against a mechanical stop. The position of the probes 210*a*–210*b* are measured by measuring the angle of rotation of the probes pivot point at the section 203. This angle in conjunction with the angle of rotation of the sub-assembly relative to the rest of the tool 10 and the known diameter of the device 200 and the length of the probes 210 are sufficient to perform a real-time inverse kinematic calculation of the endpoints 211*a* and 211*b* of the probes 210*a* and 210*b*. By associating this end point location with the tool's current depth, a string of three dimensional data points is created which creates a spiral of data in the direction of the movement of the tool 10 representing wall location. This data is converted into three dimensional maps or pictures of the imaging device environment by utilizing programs stored in the tool 10 or the surface control unit 70. The resolution of the maps is determined by the rate of travel of the tool. By varying the rotational speed of the probes 210*a*–210*b* and the data acquisition rate per revolution, the resolution can be adjusted to provide useable three dimensional maps of the wellbore interior.

The three dimensional images can be displayed on the display 72 where a user or operator can rotate and manipulate the images in other ways to obtain a relatively accurate quantitative picture and an intuitive representation of the downhole environment. Although only a single probe 210 is sufficient in obtaining three-dimensional pictures, it is preferred that at least two probes, such as probes 210*a*–210*b*, are utilized. Two or more probes enable cross-correlation of the image obtained by each of the probes 210*a*–210*b*.

In the embodiment described above, since the probes 210 are pressed against the wellbore wall, there is a potential for dynamic effects to create blind spots artificially making the objects look larger than they really are. The controller continuously monitors for changes in the probe location which are near the rate at which a freely expanding probe 210 moves. If such a situation occurs, the rotational rate of the probes 210 is reduced and/or the pass is repeated. Also, if a feature is detected, the imaging device 200 preferably alerts the user and if appropriate, the imaging device slows down to make a higher resolution image of the unusual feature.

Figure 6:
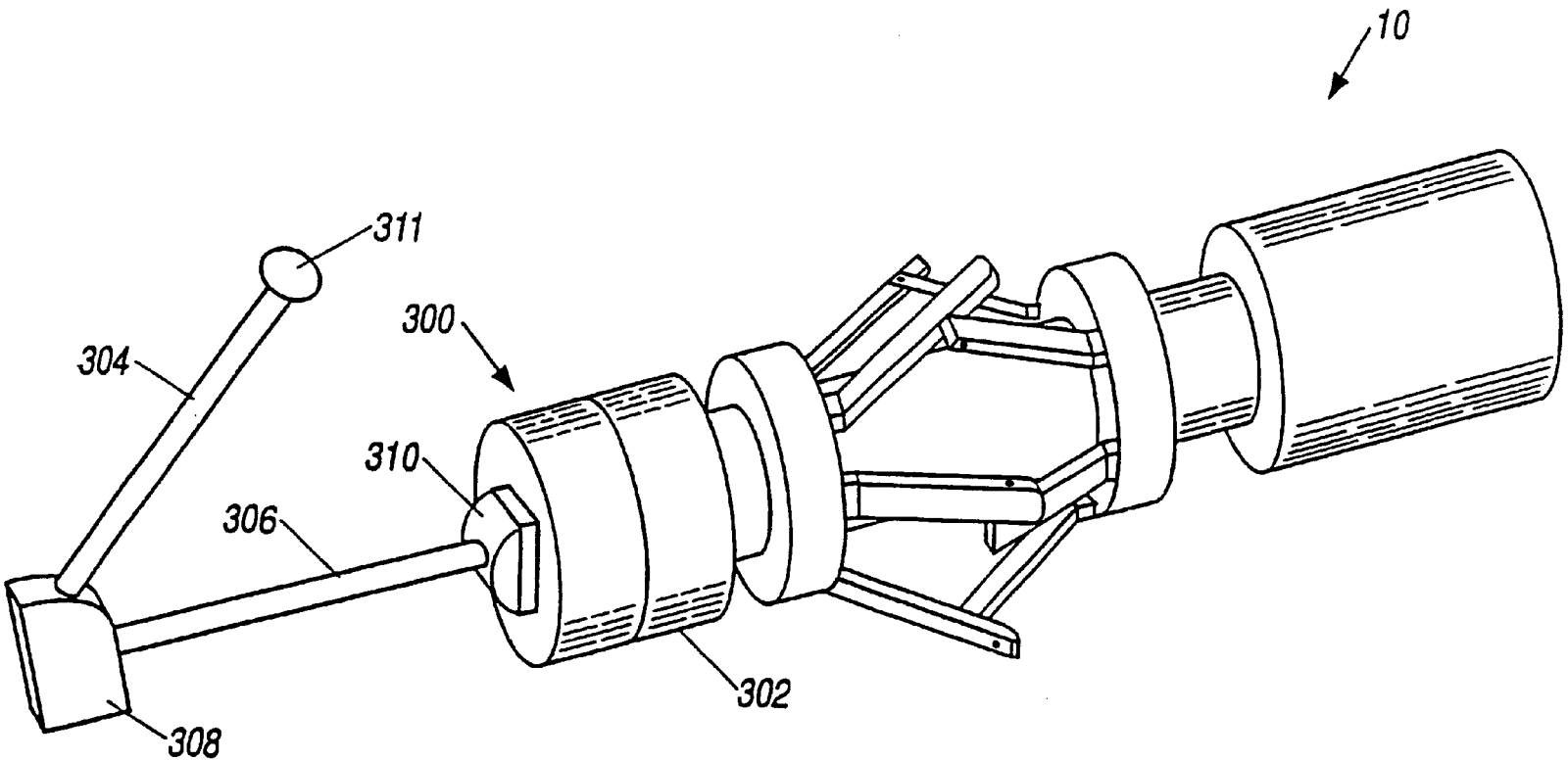
FIG. 6 is an isometric view of an alternative embodiment of a tactile imaging device and a portion of the mobility device show in FIG. 1.

FIG. 6 shows an embodiment of a tactile imaging device 300 that may be attached to the front end of the downhole tool 10 (FIG. 1) to image a work site downhole or in front of the tool 10. The device 300 includes a rotating joint 302 rotatable about the longitudinal axis of the tool 10. The probe assembly includes a probe arm 304 and a pivot arm 306, each such arm pivotly joined at a rotary joint 308. The pivot arm 306 terminates at a probe tip 311. The other end of the pivot arm 306 is attached to the joint 302 via a rotary joint 310. In operation, the device 300 is positioned adjacent to the work site. The rotary joint 302 rotates the probe tip 311 within the wellbore 22. The rotary joint 310 enables the pivot arm 306 to move in a plane along the axis of the tool 10 while the joint 308 allows the probe arm 304 to move about the joint 308 like a forearm attached at an elbow. The linear degree of freedom to the device 300 is provided by the linear motion of the tool 10. The radial movement in the wellbore is provided by the rotation of the joint 302. The joints 308 and 310 provide additional degrees of freedom that enable positioning the probe tip 311 at any location within the wellbore 22. The device 300 is moved within the wellbore 22 and the position of the probe tip 311 is calculated relative to the tool 10 and correlated with the depth of the tool 10 in the wellbore. The position data calculated is utilized to provide an image of the wellbore inside. The probe arm 304 of the device 300 may be extended toward the front of the tool 10 to allow probing an object lying directly in front of the tool 10.

The above-described tool 10 configuration permits utilizing relatively small outside dimensions (diameter) to perform operations in relatively large diameter wellbores 22. This is due to the fact that the length of the levers of the mobile platform, the probes of the tactile image device and the cutting tool extend outwardly from the tool body, which allows maintaining a relatively high ratio between the wellbore internal dimensions and the tool body diameter. Additionally outwardly extending or biased arms or other suitable devices may be utilized on the tool body to cause the tool 10 to pass over branch holes for multi-lateral wellbore operations.

It is often desirable to measure selected wellbore and formation parameters either prior to or after performing an end work. Frequently, such information is obtained by logging the wellbore 22 prior to performing the end work, which typically requires an extra trip downhole. The tool 10 may include one or more logging devices or sensors. For example, a collar locator may be incorporated in the service tool 10 to log the depth of the tool 10 while tripping downhole. Collar locators provide relatively precise measurements of the wellbore depth and can be utilized to correlate depth measurement made from surface instruments, such as wheel type devices. The collar locator depth measurements can be utilized to position and locate the imaging and end work devices 30 of the tool 100 in the wellbore. Also, casing inspection devices, such as eddy current devices or magnetic devices may be utilized to determine the condition of the casing, such as pits and cracks. Similarly, a device to determine the cement bond between the casing and the formation may be incorporated to obtain a cement bond log during tripping downhole. Information about the cement bond quality and the casing condition are especially useful for wellbores 22 which have been in production for a relatively long time period or wells which produce high amounts of sour crude oil or gas. Additionally, resistivity measurement devices may be utilized to determine the presence of water in the wellbore or to obtain a log of the formation resistivity. Similarly gamma ray devices may be utilized measure background radiation. Other formation evaluation sensors may also be utilized to provide corresponding logs while tripping into or out of the wellbore.

Figure 7:
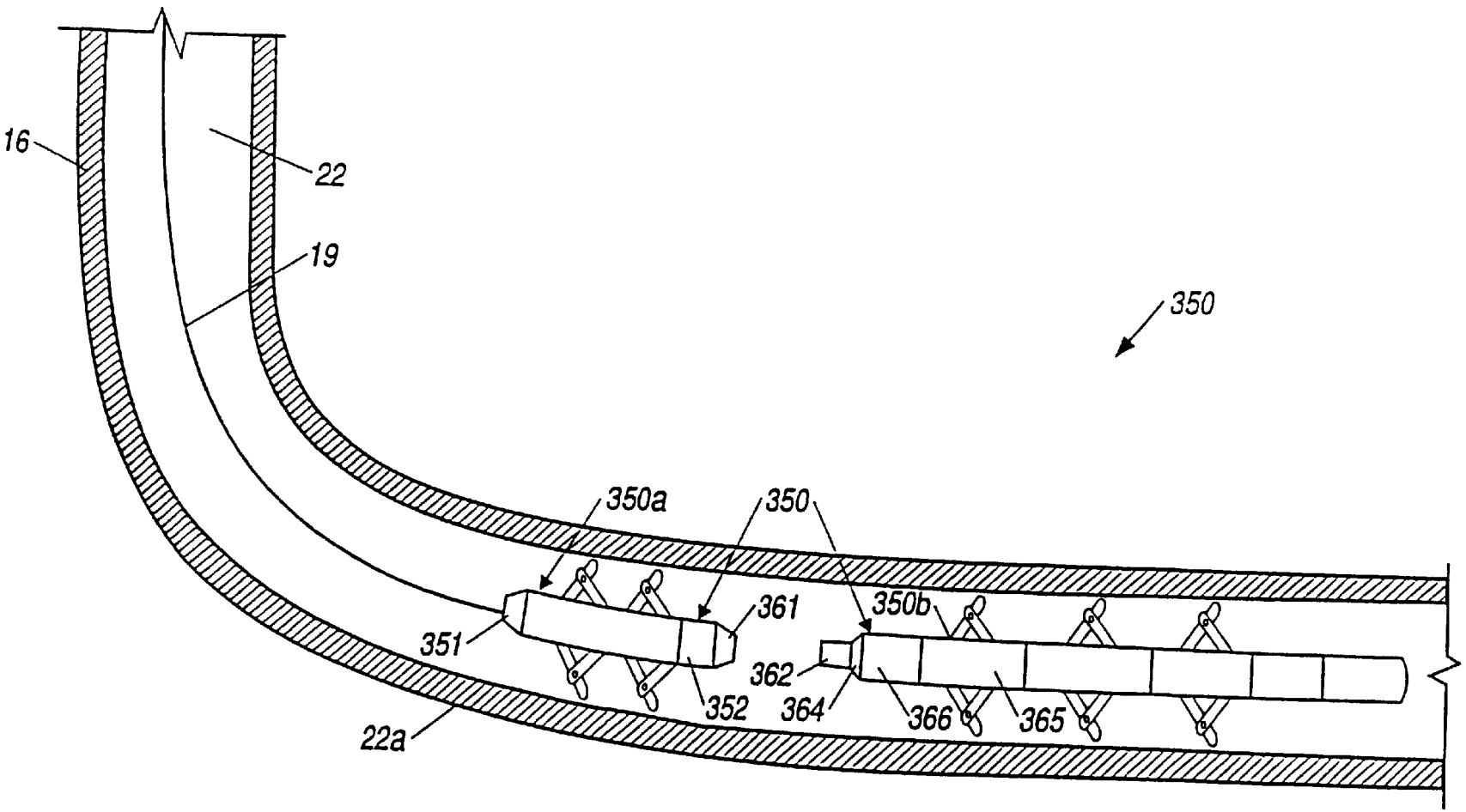
FIG. 7 is a schematic showing an alternative embodiment of a downhole tool according to the present invention deployed in a wellbore for use in the system of FIG. 1.

In extended reach wellbores, the use of a wireline may require a mobility platform to generate excessive force as the depth increases due to the increased length of the wireline that must be pulled by the platform. In a production wellbore, it may be desirable to deploy untethered tools to service wellbore areas where the tethered wireline may impede the mobility of the platform. FIG. 7 shows a downhole tool 350 made after the schematic of FIG. 2B that may be utilized to traverse the wellbore to perform downhole operations without a tethered wireline. The tool 350 is composed of two units: a base unit 350*a* attached to the wireline 24 at its uphole end 351 and having a downhole connector 361 at its downhole end 352; and a battery-powered mobile unit 350*b*.

The mobile unit 350*a* includes the mobile platform and the end work device and may include an imaging device and any other desired device that is required to perform the desired downhole operations as explained earlier with respect to the tool 10 (FIG. 1). The mobile unit 350*b* also preferably includes all the electronics, data gathering and processing circuits and computer programs (generally denoted by numeral 365) required to perform operations downhole without the aid of surface control unit 70. A suitable telemetry system may also be utilized in the base unit 350*a* and the mobile unit 350*b* to communicate command signals and data between the units 350*a* and 350*b*. The mobile unit 350*b* terminates at its uphole end 364 with a matching detachable connector 362. The mobile unit 350*b* is designed so that upon command or in response to programmed instructions associated therewith, it can cause the connector 362 to detach it from the connector 361 and travel to the desired work site in the wellbore 22 to perform the intended operations.

To operate the tool 350 downhole, the tool units 350*a* and 350*b* are connected at the surface. The tool 350 is then conveyed into the wellbore 22 to a suitable location 22*a* by a suitable means, such as a wireline or coiled tubing 24. The conveying means 24 is adapted to provide electric power to the base unit 350*a* and contains data communication links for transporting data and signals between the tool 350 and the surface control unit 70. Upon command from the surface control unit 70 or according to programmed instructions stored in the tool 350, the mobile unit 350*b* detaches itself from the base unit 350*a* and travels downhole to the desired work site and performs the intended operations. Such a mobile unit 350*b* is useful for performing periodic maintenance operations such as cleaning operations, testing operations, data gathering operations with sensors deployed in the mobile unit 350*b*, gathering data from sensors installed in the wellbore 22 or for operating devices such as a fluid control valve or a sliding sleeve. After the mobile unit 350*b* has performed the intended operations, it returns to the base unit 350*a* and attaches itself to the base unit 350*a* via the connectors 361 and 362. The mobile unit 350*b* includes rechargeable batteries 366 which can be recharged by the power supplied to the base unit 350*a* from the surface via the conveying means 24.

The general operation of the above described tools is described by way of an example of a functional block diagram for use with the system of FIG. 1. Such methods and operations are equally applicable to the other downhole service tools made according to the present invention. Such operations will now be described while referring to FIG. 8, which is a block diagram of the functional operations of the system 100 (see FIG. 1).

Figure 8:
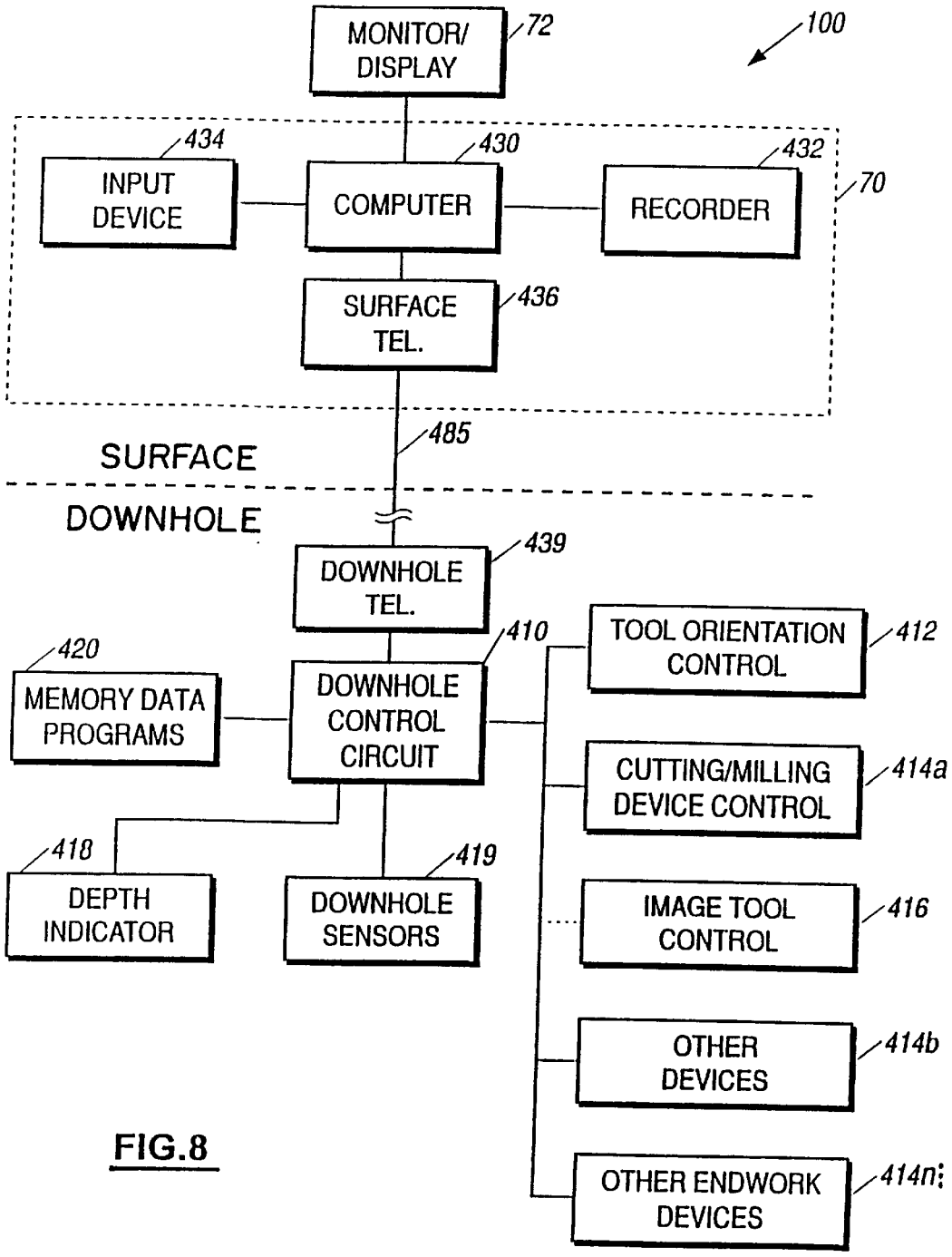
FIG. 8 shows a functional block diagram relating to the operation of the system of FIG. 1.

Referring to FIG. 8, the downhole tool 10 preferably includes one or more microprocessor-based downhole control circuit or module 410. The control module 410 determines the position and orientation of the tool 10 shown as a task box 412. The control circuit 410 controls the position and orientation of the cutting element 30 (FIG. 1) as a task box 414. Similarly, control module 410 may control any other end work devices, generally designated herein by boxes 114*b–n*. During operations, the control module 410 receives information from other downhole devices and sensors, such as a depth indicator 418 and orientation devices, such as accelerometers and gyroscopes. The control circuit 410 may communicate with the surface control unit 70 via the downhole telemetry 439 and via a data or communication link 485. The control circuit 410 preferably controls the operation of the downhole devices. The downhole control circuit 410 includes memory 420 for storing data and programmed instructions therein. The surface control unit 70 preferably includes a computer 430, which manipulates data, a recorder 432 for recording images and other data and an input device 434, such as a keyboard or a touch screen for inputting instructions and for displaying information on the monitor 72. As noted earlier, the surface control unit 70 and the downhole tool 10 communicate with each other via a suitable two-way telemetry system.

While the foregoing disclosure is directed to the preferred embodiments of the invention, various modifications will be apparent to those skilled in the art. It is intended that all variations within the scope and spirit of the appended claims be embraced by the foregoing disclosure.

What Is claimed is:

1. A tool for performing a desired operation in a wellbore, comprising:

A. a mobility device carried by the tool for moving the tool in the wellbore, said mobility device being driven by an electrically operated device and including:

i. a body having a plurality of reduced-dimensioned, spaced apart portions on an outer surface of the body; and ii. a separate brace at each of the reduced-dimensioned portions, each such brace having at least one movable member adapted to move between a first collapsed position and a second radially extended position, each said movable member urging against the inside of the wellbore when it is in its extended position; and iii. a first movable magnet within the tool body adjacent each of the braces and a corresponding second movable magnet in the reduced portion, wherein the movement of the first magnet in the tool causes its corresponding magnet in the reduced dimensioned space to move, thereby causing the movable member of the brace to move between its collapsed and extended position.

2. The tool according to claim 1, further having an electric motor associated with each first moveable magnet within the body for causing the first magnet to move between first and second positions.

3. The tool according to claim 2, further having a screw-type mechanism associated with each of the first magnets and operated by the electric motor associated with such first magnet to cause the first magnet to move between its first and second position.

4. A tool for performing a desired operation in a wellbore, comprising:

A. a mobility device for moving the tool in the wellbore, said mobility device having, i. a body, ii. a plurality of braces, each brace having at least one movable member between a first collapsed position and a second radially extended position, each said movable member adapted to urge against an interior surface of the wellbore when said movable member is in its extended position, iii. a device carried by the tool for moving each of the movable members between their respective first collapsed positions and the second radially extended positions, wherein the movement of the movable members between their respective collapsed and extended positions causes the tool to move within the wellbore; and iv. an electromagnetic device associated with each said brace to cause the movable member of such brace to move between its first collapsed position and the second, radially extended position; and B. an end work device carried by the tool for performing the desired operation at a selected work site in the wellbore.

5. The tool according to claim 4, wherein each electromagnetic device includes a first movable magnet inside the tool and a second movable magnet on the outside of the tool.

6. The tool according to claim 4, wherein the electromagnetic devices move their respective movable members in unison.

* * * * *